US010870938B2

(12) United States Patent
Shiraishi et al.

(10) Patent No.: US 10,870,938 B2
(45) Date of Patent: Dec. 22, 2020

(54) SEWING MACHINE

(71) Applicant: JUKI CORPORATION, Tama (JP)

(72) Inventors: Atsushi Shiraishi, Tama (JP); Naofumi Fukuba, Tama (JP); Daishi Kuramashi, Tama (JP)

(73) Assignee: JUKI CORPORATION, Tama (JP)

( * ) Notice: Subject to any disclaimer, the term of this patent is extended or adjusted under 35 U.S.C. 154(b) by 111 days.

(21) Appl. No.: 16/053,019

(22) Filed: Aug. 2, 2018

(65) Prior Publication Data

US 2019/0040558 A1 Feb. 7, 2019

(30) Foreign Application Priority Data

Aug. 3, 2017 (JP) ..... 2017-150314

(51) Int. Cl.

| | |
|---|---|
| ***D05B 19/14*** | (2006.01) |
| ***D05B 69/18*** | (2006.01) |
| ***D05B 69/12*** | (2006.01) |
| *D05B 29/06* | (2006.01) |

(52) U.S. Cl.

CPC ..... *D05B 19/14* (2013.01); *D05B 69/12* (2013.01); *D05B 69/18* (2013.01); *D05B 29/06* (2013.01)

(58) Field of Classification Search

CPC ..... D05C 13/02; D05B 19/14; D05B 69/20
USPC ..... 112/470.03, 272, 475.02, 455, 456, 315
See application file for complete search history.

(56) References Cited

U.S. PATENT DOCUMENTS 4,691,652 A * 9/1987 Leclaire ..... D05B 69/20 112/272
4,729,329 A * 3/1988 Leclaire ..... D05B 69/24 112/272
4,858,545 A * 8/1989 Balke ..... D05B 69/20 112/275
4,896,617 A * 1/1990 Hauser ..... D05B 1/24 112/176
5,033,400 A * 7/1991 Fischer ..... B65H 59/24 112/254

(Continued)

FOREIGN PATENT DOCUMENTS

JP 4724938 B2 7/2011

OTHER PUBLICATIONS

Peng Zhang, Sensors and Actuators for Industrial Control, 2008, Industrial Control Technology, pp. 16-21, accessed via https://www.sciencedirect.com/topics/engineering/linear-variable-differential-transformer (last visited Jan. 14, 2020). (Year: 2008).*

*Primary Examiner* — Alissa L Hoey
*Assistant Examiner* — Patrick J. Lynch
(74) *Attorney, Agent, or Firm* — Faegre Drinker Biddle & Reath LLP

(57) ABSTRACT

A sewing machine includes a movement amount detector which is configured to detect a movement amount of a workpiece, a motor which is a rotation driving source of an upper shaft configured to provide a vertical motion to a needle bar, and a control device which is configured to control the motor based on detection of the movement amount detector to maintain a constant stitch length. The movement amount detector is supported to be capable of being raised and lowered around a stitch position. The sewing machine includes a pressing unit configured to provide an upward elastic force such that a detection surface of the movement amount detector protrudes from an upper surface of a throat plate.

6 Claims, 2 Drawing Sheets

(56) References Cited

U.S. PATENT DOCUMENTS

| | | | | |
|---|---|---|---|---|
| 5,370,072 | A * | 12/1994 | Adamski, Jr. | D05B 55/102 112/306 |
| 6,591,769 | B1 * | 7/2003 | Heidtmann | D05B 29/02 112/237 |
| 6,959,657 | B1 * | 11/2005 | Duval | D05B 19/14 112/272 |
| 2002/0020335 | A1 * | 2/2002 | Sherwin | D05B 21/00 112/475.04 |
| 2003/0005870 | A1 * | 1/2003 | Matsuzawa | D05B 19/12 112/102.5 |
| 2007/0005175 | A1 * | 1/2007 | Konig | D05B 19/00 700/138 |
| 2007/0256619 | A1 * | 11/2007 | Koemer | D05B 19/14 112/470.05 |
| 2009/0007829 | A1 * | 1/2009 | Shimizu | D05B 19/12 112/470.01 |
| 2011/0239922 | A1 * | 10/2011 | Gonzalez | D05B 19/16 112/470.03 |
| 2011/0303138 | A1 * | 12/2011 | Flygare | D05B 19/16 112/470.03 |
| 2012/0234222 | A1 * | 9/2012 | Naka | D05B 19/12 112/470.03 |
| 2015/0122164 | A1 * | 5/2015 | Dickerson | D05B 19/16 112/470.03 |
| 2015/0259838 | A1 * | 9/2015 | Schwarzberger | D05B 11/00 112/475.17 |
| 2017/0121878 | A1 * | 5/2017 | Koike | D05B 2/24 |
| 2018/0080156 | A1 * | 3/2018 | Nakajima | D05B 27/02 |
| 2018/0355532 | A1 * | 12/2018 | Chen | D05B 55/14 |

* cited by examiner

SEWING MACHINE

CROSS-REFERENCE TO RELATED APPLICATIONS

The present application claims the benefit of priority of Japanese Patent Application No. 2017-150314, filed on Aug. 3, 2017, the content of which is incorporated herein by reference.

TECHNICAL FIELD

Aspects of the present invention relate to a sewing machine which detects a movement amount of a workpiece relative to the sewing machine.

BACKGROUND ART

There has been known a sewing machine which maintains a stitch pitch to be constant by acquiring a movement amount of a workpiece on a throat plate by an optical sensor fixedly mounted on a frame of the sewing machine and controlling a rotation speed of a motor such that stitching is made with a constant movement amount (refer to JP4724938B).

However, as illustrated in FIG. 4, in the related-art sewing machine, when a needle 112 is pulled up, a workpiece C is pulled up together with the needle 112, and thus, the workpiece C is separated from a sensor 121 and a throat plate 116, so that detection accuracy of the movement amount of the workpiece C deteriorates.

SUMMARY

Accordingly, an aspect of the present invention provides a sewing machine which detects a movement amount of a workpiece by reducing the influence when a needle on the workpiece is raised.

According to an illustrative embodiment of the present invention, there is provided a sewing machine including:

a movement amount detector which is configured to detect a movement amount of a workpiece;

a motor which is a rotation driving source of an upper shaft configured to provide a vertical motion to a needle bar; and a control device which is configured to control the motor based on detection of the movement amount detector to maintain a constant stitch length, wherein the movement amount detector is supported to be capable of being raised and lowered around a stitch position, the sewing machine further including a pressing unit configured to provide an upward elastic force such that a detection surface of the movement amount detector protrudes from an upper surface of a throat plate.

In the sewing machine, free motion stitching may be performed by manually moving the workpiece with respect to the stitch position of the sewing machine.

In the sewing machine, free motion stitching may be performed by manually moving the sewing machine with respect to the workpiece.

According to the above configuration, the movement amount detector is provided with the upward elastic force by the pressing unit. Therefore, in a case where the workpiece is pulled up at the time when the needle is raised, the movement amount detector is raised to follow the workpiece, so that a gap between the movement amount detector and the workpiece is reduced. Accordingly, the movement amount of the workpiece can be favorably detected.

DETAILED DESCRIPTION

Overall Configuration

Figure 1:
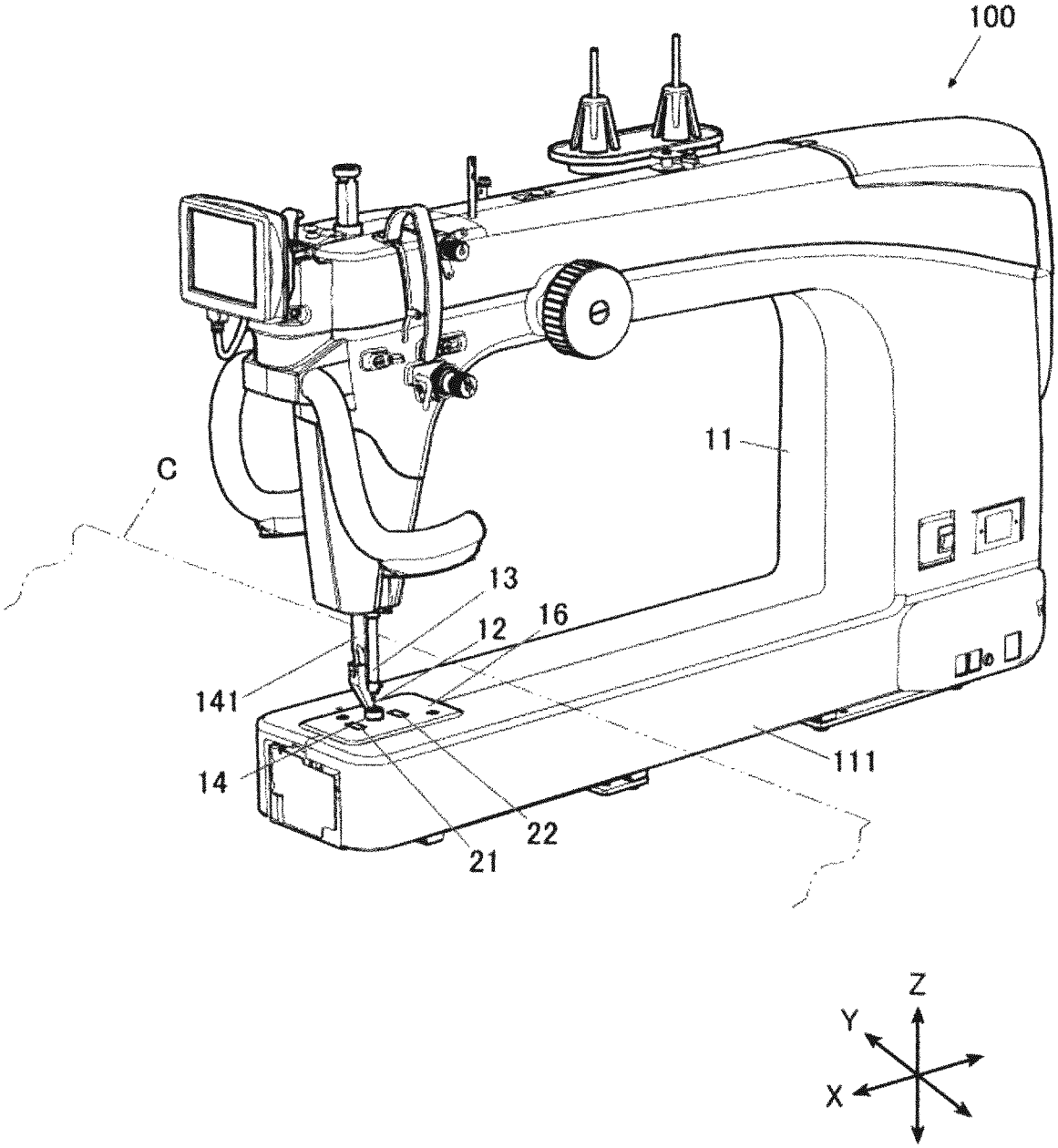
FIG. 1 is a perspective view of a sewing machine according to an embodiment of the invention.

Hereinafter, a sewing machine according to an embodiment of the present invention will be described with reference to the drawings. FIG. 1 is a perspective view of a sewing machine 100.

The sewing machine 100 according to the embodiment is a sewing machine which can perform so-called free motion stitching, in which an operator freely moves a cloth C serving as a workpiece held by a dedicated holding table by a manual operation and which performs sewing while relatively positioning the cloth C with respect to a stitch position.

In the embodiment, since the structure of the holding table is similar to that of a known holding table, the illustration and the description thereof will be omitted.

The sewing machine 100 includes a needle bar vertical moving mechanism (not illustrated) for vertically moving a needle bar 13 which holds a needle 12 at a lower end portion thereof; a shuttle mechanism for capturing an upper thread passed through the needle 12 and for entwining the upper thread with a lower thread; a thread take-up lever mechanism for forming a knot by pulling up the upper thread; a thread tensioner for providing a predetermined tension to the upper thread; a frame 11 for accommodating or holding these members; and a control device which is an example of a control unit for performing operation control of each components.

Since the shuttle mechanism, the thread take-up lever mechanism, and the thread tensioner are similar to known configurations in the sewing machine, the detailed description thereof will be omitted.

The frame 11 includes a bed portion 111 which is positioned at a lower part of a sewing machine main body, an upright drum portion which stands from one end portion of the bed portion 111, and an arm portion which extends in the same direction as the bed portion from the upright drum portion.

In the following description, a direction which is a horizontal direction and is along a longitudinal direction of the bed portion 111 is referred to as an X-axis direction, a direction which is a horizontal direction and is orthogonal to the X-axis direction is referred to as a Y-axis direction, and a perpendicularly vertical direction which is orthogonal to the X-axis direction and the Y-axis direction is referred to as a Z-axis direction.

The needle bar vertical moving mechanism includes a motor which is an example of a driving source of a sewing operation, an upper shaft in which rotational driving is performed by the motor, and a crank mechanism (not illustrated) which converts the torque of the upper shaft into a vertical reciprocating motion to provide the vertical reciprocating motion to the needle bar 13.

An encoder which is an example of an axial angle detector is mounted on an output shaft of the motor and outputs pulses in accordance with an axial angle change amount of the output shaft.

A transmission ratio from the output shaft of the motor to the upper shaft is known, the control device can calculate a shaft angle of the output shaft of the motor from the pulse output of the encoder and can further calculate the shaft angle of the upper shaft from the transmission ratio.

The encoder may be provided on the upper shaft and the axial angle of the upper shaft may be directly detected.

The sewing machine 100 includes a middle presser foot 14 for pressing the cloth C such that the needle 12 is smoothly removed from the cloth C when the needle 12 is raised. The middle presser foot 14 is supported in the lower end portion of a middle presser foot rod 141. The middle presser foot 14 is a small frame body capable of loosely inserting the needle 12 therein, obtains power from the motor which is an example of a driving source for vertically moving the needle bar 13 via a known transmission mechanism, and vertically moves with amplitude smaller than that of the needle bar 13. A phase of the middle presser foot 14 is shifted from that of the needle bar 13, and the middle presser foot 14 is lowered when the needle 12 is raised. The middle presser foot 14 is set to have a higher bottom dead center height than the upper surface of a throat plate 16 so as not to hinder the movement of the cloth C.

In the bed portion 111, on both sides in the X-axis direction of a needle hole 162 (refer to FIG. 2) which corresponds to the stitch position of the throat plate 16, there is provided first and second sensors 21, 22 which are examples of movement amount detectors for detecting the relative movement amount in the vicinity of the stitch position of the sewing machine 100 with respect to the cloth C which is manually fed.

The first and second sensors 21, 22 are two-dimensional image sensors which are fixedly mounted in a state of facing upward from an upper surface of the throat plate 16.

The first and second sensors 21, 22 are disposed such that both optical axes are parallel to the Z-axis direction and become symmetrical with respect to a plane including a center line of the needle bar 13.

Figure 2:
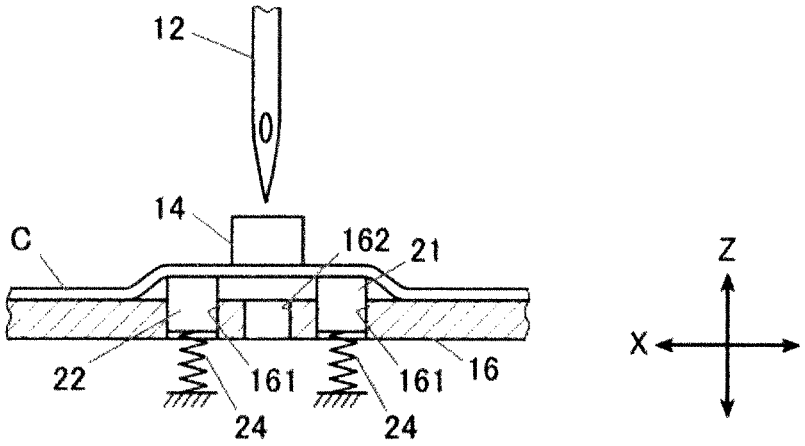
FIG. 2 is a vertical sectional view around a stitch position.

As illustrated in FIG. 2, both the first and second sensors 21, 22 are inserted and supported respectively in two through-holes 161 formed in the throat plate 16 in the vertical direction, and each of the sensors 21, 22 slides in the through-hole 161 and is supported to be capable of being raised and lowered in the vertical direction with respect to the throat plate 16.

A compression coil spring 24 which is an example of a pressing unit is individually disposed under the first and second sensors 21, 22, and the first and second sensors 21, 22 are pressed upward.

Therefore, in a state where the sensors 21, 22 are not pressed downward, the sensors 21, 22 are in a state where upper end portions thereof including detection surfaces protrude from the upper surface of the throat plate 16.

In each of the sensors 21, 22, a stopper (not illustrated) is provided, and the upper limit height is set so as not to be completely removed upward from the through-hole 161.

The upper limit height of each of the sensors 21, 22 is set such that the detection surface of each of the sensors 21, 22 is higher than the height of the bottom surface of the middle presser foot 14 when positioned at the bottom dead center.

A processing device (not illustrated) is provided to the first and second sensors 21, 22, and based on detection signals of each of the sensors 21, 22, every time a change in resolution unit of the movement amount of the cloth C occurs, the pulse signal is input to the control device.

Herein, one of the first and second sensors 21, 22 is determined in advance as a main sensor and the other one is determined as a sub sensor, and the processing device inputs a pulse signal based on the detection of the main sensor to the control device, and a pulse signal based on the detection of the sub sensor is input to the control device when an error occurs in the main sensor.

Sewing Operation of Sewing Machine

The sewing operation in the sewing machine 100 will be described.

First, when the cloth C is held on the holding table, the cloth C is in a sliding-contact with the upper surface of the throat plate 16 of the sewing machine 100. At this time, the first and second sensors 21, 22 are pressed from above by the cloth C, and is in a state where the detection surface of the upper end portion thereof is pushed down to substantially the same height as the upper surface of the throat plate 16.

When a pedal (not illustrated) of the sewing machine 100 is depressed, the motor is driven and the sewing is started. The operator moves the cloth C held on the holding table and arbitrarily forms seams.

At the time of the sewing, the middle presser foot 14 moves vertically in a state where the phase is shifted by a half cycle while being synchronized with the vertical movement of the needle 12. Accordingly, the middle presser foot 14 is lowered when the needle 12 is pulled up.

At this time, as illustrated in FIG. 2, the cloth C is pulled up to the needle 12 and floats up from the throat plate 16 to be a state of abutting against a bottom portion of the middle presser foot 14. Further, following the floating of the cloth C, the first and second sensors 21, 22 protrude from the upper surface of the throat plate 16, and the detection surface abuts against the lower surface of the cloth C. Therefore, even when the cloth C floats up, the detection surfaces of the first and second sensors 21, 22 are not separated from the cloth C, and the detection of the movement amount of the cloth C can be favorably continued.

When the movement amount of the cloth C is detected, the control device controls the rotation speed of the motor such that the speed corresponds to the movement amount of the cloth C, so that stitch point is controlled to become a target stitch pitch.

Figure 3:
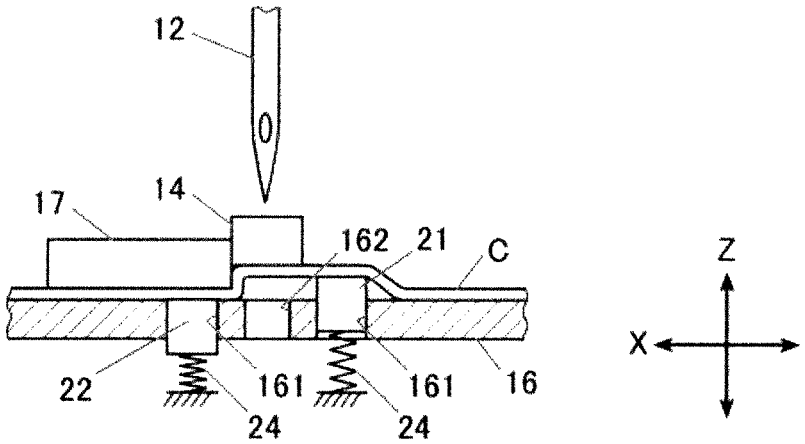
FIG. 3 is a vertical sectional view around the stitch position when using a ruler.
Figure 4:
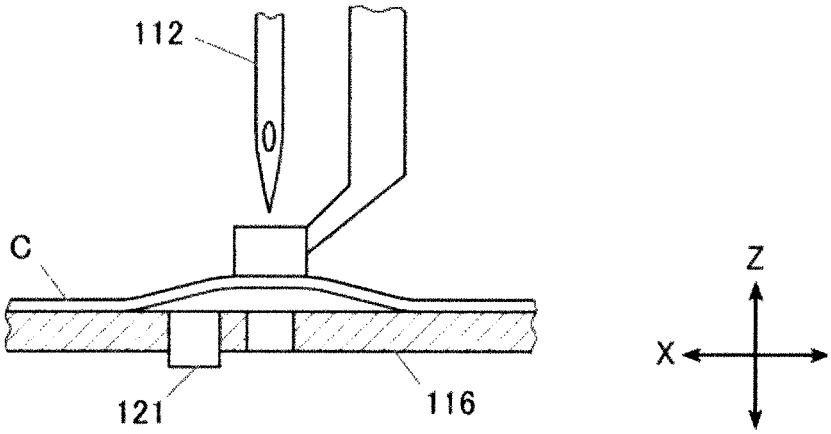
FIG. 4 is a vertical sectional view around a stitch position in a related-art sewing machine.

Incidentally, at the time of the free motion stitching, as illustrated in FIG. 3, a ruler 17 is mounted on the holding table and the cloth C is moved while the end edge portion of the ruler 17 abuts against the middle presser foot 14, and thus the seams may be formed along the shape of the end edge portion of the ruler 17.

Even in a case where the ruler 17 is used, since the first and second sensors 21, 22 can be easily pushed down to the height where the detection surface is flush with the upper surface of the throat plate 16, the ruler 17 may not be caught by the first or second sensor 21 or 22 when moving slidably, and excellent sewing can be performed.

An outer circumference of the upper end portions of the first and second sensors 21, 22 may be formed into a taper shape or round shape such that the ruler 17 can be pressed down more reliably and smoothly.

Technical Effects

In the sewing machine 100, the first and second sensors 21, 22 are supported to be capable of being raised and lowered around the stitch position in the throat plate 16, and the compression coil spring 24 which provides the upward elastic force is provided under each of the sensors 21, 22 such that the detection surfaces of the first and second sensors 21, 22 protrude from the upper surface of the throat plate 16.

Therefore, even in a case where the cloth C is pulled up together with the needle 12 at the time of raising the needle 12, each of the sensors 21, 22 is raised following the raising of the cloth C, the detection surface is not separated from the cloth C, and thus, the movement amount of the cloth C can be favorably detected.

In the sewing machine 100, the free motion stitching is performed by manually moving the cloth C with respect to the stitch position, but the influence of the vertical motion of the cloth C generated at the time of sewing can be reduced, the movement amount can be detected with high accuracy, and thus, the target stitch point can be maintained to be constant, and the sewing can be performed with high sewing quality.

Others

In the above-described sewing machine 100, the case is exemplified in which the cloth C is manually moved with respect to the sewing machine 100. However, the sewing machine 100 may be a sewing machine which performs the free motion stitching by manually moving the sewing machine 100 with respect to the cloth C.

Although the compression coil spring 24 is exemplified as the pressing unit, any elastic body capable of providing the upward elastic force can be used as a pressing unit. For example, a plate spring or an air spring may be used.

It may be preferred that the elastic force by the pressing unit is adjustable. For example, in a case where the compression coil spring 24 is used, the compression length thereof can be adjusted by screws or the like.

Although a case has been exemplified in which the first and second sensors 21, 22 are disposed on both sides in the X-axis direction of the needle hole 162, as long as the optical axis is parallel to the Z-axis direction and is disposed so as to be symmetrical with respect to a plane including the center line of the needle bar, the first and second sensors 21, 22 may be disposed in any manner. For example, the first and second sensors 21, 22 may be disposed on both sides of the needle hole 162 in the Y-axis direction.

The invention claimed is:

1. A sewing machine comprising:

a movement amount detector which is configured to detect a movement amount of a workpiece;

a motor which is a rotation driving source of an upper shaft configured to provide a vertical motion to a needle bar; and a control device which is configured to control the motor based on detection of the movement amount detector to maintain a constant stitch length, wherein the movement amount detector is a two-dimensional image sensor, wherein the movement amount detector is supported in a throat plate to be capable of being raised and lowered within the throat plate around a stitch position, the sewing machine further comprising:

a pressing unit disposed beneath the movement amount detector and configured to provide an upward elastic force such that a detection surface of the movement amount detector protrudes from an upper surface of the throat plate.

2. The sewing machine according to claim 1, wherein free motion stitching is performed by manually moving the workpiece with respect to the stitch position of the sewing machine.

3. The sewing machine according to claim 1, wherein free motion stitching is performed by manually moving the sewing machine with respect to the workpiece.

4. The sewing machine according to claim 1, wherein the movement amount detector includes two sensors which are configured to detect the movement of the workpiece and disposed on both sides of the stitch position.

5. The sewing machine according to claim 1, wherein an optical axis of the movement amount detector is parallel to a movement direction of the needle bar.

6. The sewing machine according to claim 1, wherein the movement amount detector is supported in a through-hole formed in the throat plate.

* * * * *